United States Patent [19]

Houk

[11] 4,267,702

[45] May 19, 1981

[54] REFRIGERATION SYSTEM WITH REFRIGERANT FLOW CONTROLLING VALVE

[75] Inventor: William J. Houk, Miami, Fla.

[73] Assignee: Ranco Incorporated, Columbus, Ohio

[21] Appl. No.: 66,188

[22] Filed: Aug. 13, 1979

[51] Int. Cl.[3] ..... F25B 1/00; G05D 23/00

[52] U.S. Cl. ..... 62/115; 62/216; 236/80 R

[58] Field of Search ..... 236/80 R, 80 F; 62/222, 62/216, 190, 229, 115

[56] References Cited

U.S. PATENT DOCUMENTS

| | | | |
|---|---|---|---|
| 2,453,439 | 11/1948 | Hubbard | 62/222 |
| 2,882,695 | 4/1959 | Zwickl | 62/119 |
| 3,769,808 | 11/1973 | Kramer | 62/115 |

*Primary Examiner*—William E. Wayner

*Attorney, Agent, or Firm*—Watts, Hoffmann, Fisher & Heinke Co.

[57] ABSTRACT

A refrigeration system is disclosed having a compressor, a condenser, an evaporator, a refrigerant expansion device, a control for cycling the compressor on and off according to a sensed condition, and a refrigerant flow controlling valve. The flow controlling valve blocks the flow of refrigerant between the condenser and the evaporator when the compressor is cycled off and enables refrigerant flow between the condenser and the evaporator when the compressor is cycled on. The flow control valve includes a refrigerant pressure responsive member movable to condition the valve to block refrigerant flow in response to changes in refrigerant pressure caused by the compressor cycling off and movable to condition the valve to enable refrigerant flow in response to changes in refrigerant pressure caused by the compressor cycling on.

12 Claims, 5 Drawing Figures

REFRIGERATION SYSTEM WITH REFRIGERANT FLOW CONTROLLING VALVE

BACKGROUND OF THE INVENTION

1. Field of the Invention

The present invention relates to refrigeration systems and more particularly relates to compressor-condenser-evaporator type refrigeration systems wherein the compressor is cyclically operated.

Refrigeration systems of the sort generally employed in household refrigerators, chillers and coolers of various descriptions include a positive displacement refrigerant compressor, a refrigerant condenser and a refrigerant evaporator to which refrigerant flows from the condenser via an expansion device which restricts the refrigerant flow. High pressure gaseous refrigerant is discharged from the compressor into the condenser where heat is transferred from the refrigerant resulting in its liquification at high pressure. The refrigerant passes through the expansion device and returns to its gaseous state in the evaporator, absorbing heat from the surroundings of the evaporator in the process and resulting in the evaporator producing a cooling effect. Low pressure gaseous refrigerant is returned to the compressor intake from the evaporator.

The compressor is typically cycled on and off in response to the sensed temperature of a medium (air, water, etc.) cooled by the evaporator. When a desired low temperature level is sensed the compressor is cycled off so that the flow of high pressure gaseous refrigerant from the compressor is terminated; but the refrigerant already delivered to the condenser continues to condense and flow to the evaporator through the expansion device until the pressures in the condenser and evaporator equalize or until the compressor is cycled on again. This results in an unnecessary additional cooling effect beyond the desired temperature level and, more importantly, requires the compressor to pump the condenser back up to operating pressure each time the compressor is cycled on. In applications such as household refrigerators it has been estimated that approximately seven percent of the energy consumption of the appliance is attributable to the operation of the compressor in restoring the condenser pressure.

2. The Prior Art

In order to reduce that portion of refrigeration system energy consumption attributable to restoring the condenser pressure when the compressor is cycled on, it has been proposed that an electrically actuated refrigerant valve be placed in the refrigeration system between the condenser and evaporator. The proposed valves are operated by a solenoid which is energized to close the valve and deenergized to open the valve. Whenever the compressor is operating the solenoid is deenergized so that refrigerant flows normally through the system. When the compressor cycles off, the solenoid is energized, closing the valve and blocking flow of refrigerant from the condenser. Thus the condenser remains at an elevated pressure during periods when the compressor is inactive because refrigerant flow from it is blocked.

When the compressor is energized again the refrigerant valve reopens so that the refrigeration system immediately begins operating at close to its optimal performance level.

The refrigerant control valve operation has some drawbacks including the fact that the valve actuating solenoid is energized while the compressor is deenergized. This energization represents an additional source of system power consumption thus reducing the energy saving effect of the valve. Furthermore, solenoids can create operating noises which are disconcerting to system users because the noise occurs when the system is otherwise deactivated.

While it is possible to construct such a refrigerant valve so that the solenoid is energized to open the valve and therefore is energized only when the compressor operates, failure of the solenoid in such circumstances would result in blockage of refrigerant flow through the system when the compressor is energized. This type of failure could damage the system.

SUMMARY OF THE INVENTION

The present invention provides a new and improved method and apparatus for blocking refrigerant flow in a refrigeration system when the compressor is deactivated and for enabling refrigerant flow when the compressor is operated and wherein differential refrigerant pressure resulting from cycling the compressor is utilized for controlling whether the refrigerant flow to a refrigerant evaporator is blocked or enabled.

The present invention is applied to a refrigeration system having a refrigerant compressor, a refrigerant condensing heat exchanger, or condenser, a refrigerant evaporating heat exchanger, or evaporator, and a refrigerant expansion device between the heat exchangers. Reduction of refrigerant pressure due to termination of compressor operation is sensed and refrigerant flows from the condensing heat exchanger to the evaporating heat exchanger is blocked. Increased refrigerant pressure resulting from initiation of compressor operation is sensed and refrigerant flow to the evaporating heat exchanger is enabled.

A refrigeration system embodying the invention includes a refrigerant flow controlling valve for blocking and enabling refrigerant flow from the condensing heat exchanger. A refrigerant pressure responsive member moves to condition the valve for blocking refrigerant flow when the compressor is cycled off and moves to condition the valve for enabling refrigerant flow when the compressor is cycled on.

Preferred systems employ a flexible diaphragm exposed to system refrigerant pressures and movable in response to pressure changes to effect operation of the refrigerant flow controlling valve. One preferred device is fail-safe in that the diaphragm is biased to a position in which the valve enables refrigerant flow and if the diaphragm is perforated or develops leakage the valve enables system refrigerant flow regardless of the operating condition of the compressor.

Other features and advantages of the invention will become apparent from the following description of preferred embodiments made in reference to the following detailed description and from the drawings which form part of the specification.

DESCRIPTION OF PREFERRED EMBODIMENTS

Figure 1:
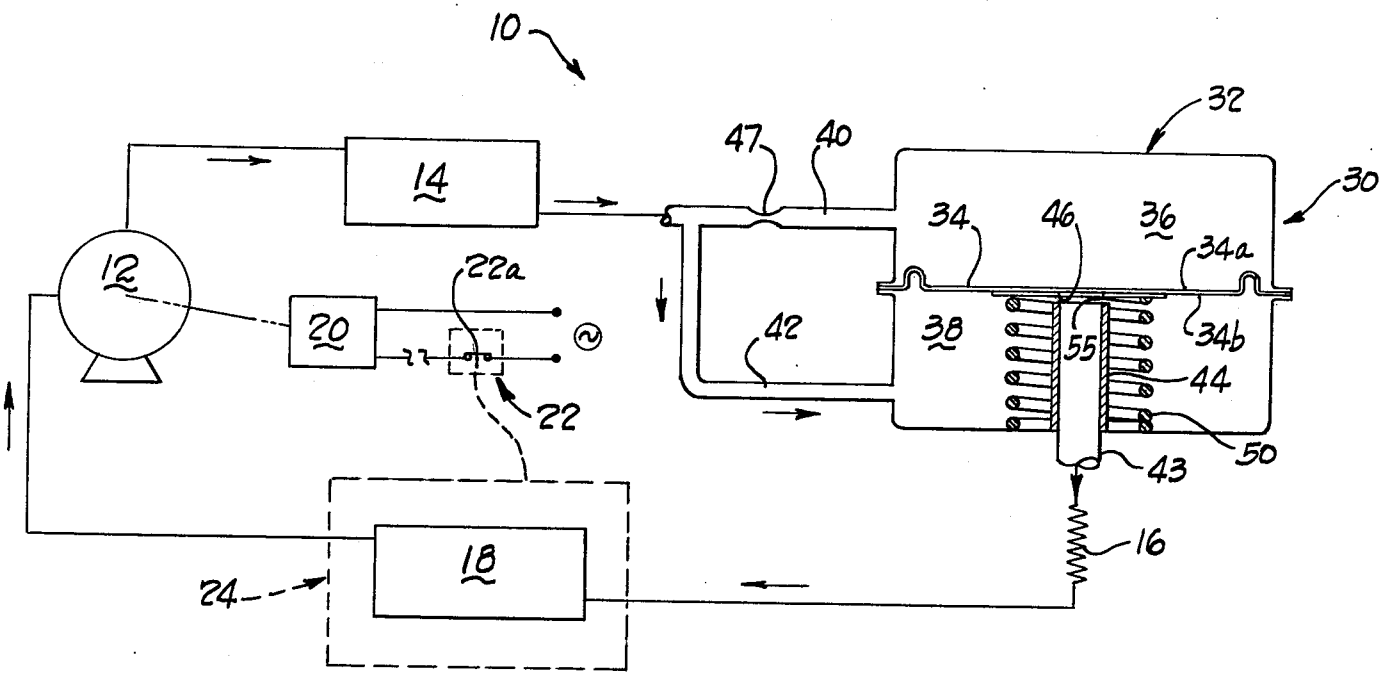
FIG. 1 is a schematic representation of a refrigeration system embodying the present invention with portions illustrated in cross section.

A refrigeration system 10 embodying the present invention is illustrated by FIG. 1 of the drawings and includes a positive displacement refrigerant compressor 12, a refrigerant condensing heat exchanger, or condenser, 14, a conventional refrigerant expansion device 16, and a refrigerant evaporating heat exchanger, or evaporator 18. The compressor 12 can be of any suitable or conventional design which is constructed so that it can be started and operated with its discharge at a substantially higher pressure than its intake. The compressor 12 is driven by an electric motor 20 which in turn is energized and deenergized in response to operation of a thermostat 22 which is schematically illustrated. The evaporator 18 is disposed within a refrigerated space 24 (schematically illustrated) and the thermostat switch contacts 22*a* are operated in response to temperature sensed by the thermostat in the space 24.

When the sensed temperature rises to a predetermined level the thermostat 22 is operated so that the motor 20 is energized to drive the compressor 12. Gaseous refrigerant at the compressor intake is compressed and delivered to the condenser 14. As the refrigerant passes through the condenser 14, heat is transferred from the refrigerant causing it to liquefy and flow from the condenser to the expansion device 16 in liquid form. The expansion device provides a flow restriction so that the liquid refrigerant flowing through the expansion device undergoes a significant pressure drop. The expansion device 16 can be of any suitable construction, such as length of capillary tubing. Refrigerant which has passed through the expansion device expands and returns to a vapor or gaseous form in the evaporator 18. As the refrigerant changes state in the evaporator 18, heat from the refrigerated space 24 is absorbed by the refrigerant causing the space temperature to be reduced.

When the temperature in the space 24 is reduced sufficiently, the thermostat switch contacts 22*a* are actuated again to deenergize the compressor drive motor 20. The compressor 12 is thus cycled on and off by the thermostat 22 to maintain the temperature levels in the space 24 within a predetermined range.

The refrigeration system 10 includes a refrigerant pressure responsive flow controlling valve 30 for blocking the flow of refrigerant between the condenser 14 and the evaporator 18 when the compressor 12 is cycled off and for enabling refrigerant flow from the condenser 14 to the evaporator 18 when the compressor is cycled on. The flow controlling valve 30 is illustrated as including a housing 32 (illustrated schematically in cross section), a refrigerant pressure responsive member 34 in the housing defining movable walls of separate chambers 36, 38 and structure for communicating refrigerant pressure to the refrigerant pressure responsive member 34.

In the embodiment of the invention illustrated by FIG. 1 the structure for communicating refrigerant pressure to the member 34 includes refrigerant passages 40, 42 which, respectively, communicate refrigerant exiting the condensing heat exchanger 16 with the respective chambers 36, 38. Refrigerant flows into the valve 30 via the passage 42 and is delivered from the valve 30 to the expansion device 16 via a discharge passage 43. A valving port structure 44 forms part of the housing discharge flow passage 43 and defines a discharge valving port 46 opening into the chamber 38.

A refrigerant flow restriction is interposed between the passages 40, 42 so that when the compressor is cycled on and off, the refrigerant pressures in the chambers 36, 38 change relative to each other but equalize after a period of time. As illustrated by FIG. 1 the flow restriction is formed by an orifice 47 in the passage 40. When the compressor is cycled on, the pressure in the chamber 38 abruptly increases relative to the pressure in the chamber 36 due to the flow restrictor 47. The pressure in the chamber 38 gradually builds to equalize the pressure in the chamber 38 as the compressor continues to operate. When the compressor is cycled off, the pressure in the chamber 38 is promptly reduced while the pressure in the chamber 36 tends to remain relatively higher. The pressure in the chamber 38 decays gradually as a result of flow through the restrictor 47 until the chamber pressures are again equalized. In short, refrigerant pressure changes in the chamber 36 lag the refrigerant pressure changes in the chamber 38.

The illustrated pressure responsive member 34 is a flexible, imperforate diaphragm which extends across the housing interior and defines opposed faces 34*a*, 34*b*. The diaphragm face 34*b* forms an annular valving surface which is seatable on an outlet valving port 46 to block refrigerant flow through the valve 30. The diaphragm 34 is biased toward a position in which the valving surface is spaced from the port 46 so that refrigerant flows through the valve 30. A helical compression spring 50 is illustrated surrounding the port structure 44 and reacting against the diaphragm 34 for this purpose. When the refrigerant pressures acting on the diaphragm 34 are equal therefore, the valve 30 is open and permits refrigerant flow through it. When the refrigerant pressure force acting on the diaphragm face 34*a* exceeds the sum of the spring biasing force and the refrigerant pressure force acting on the face 34*b* the diaphragm valving surface seats on the valving port 46 to block refrigerant flow through the valve 30.

When the compressor 12 has been operating sufficiently long to cause the sensed temperature in the space 24 to just reach the level at which the thermostat operates to cycle the compressor off, the refrigerant pressures in the chambers 36, 38 are equal and the valve 30 is open, allowing unrestricted refrigerant flow through it. When the compressor cycles off, the refrigerant pressure in the condenser 14 is abruptly reduced. The flow restricting orifice 47 prevents the pressure in the chamber 36 from being reduced as abruptly as the pressure reduction in the chamber 38 resulting in the diaphragm 34 shifting toward the valving port 46 and closing the valve 30. When this occurs the refrigerant in the port structure 44 and the discharge passage 43 continues to flow through the expansion device 16 resulting in the refrigerant pressure in the port structure 44 and passage 43 being reduced toward the low pressure level in the evaporator 18. This low pressure is distributed across the relatively large circular diaphragm area indicated by the reference character 55 within the valving port area. The diaphragm area 55 is sufficiently large, compared to the overall area of the diaphragm face 34*b*, that when the refrigerant pressures in the chambers 36, 38 equalize with the valve closed, the net force acting on the diaphragm face 34*a* exceeds the spring biasing force and the pressure forces acting on the face 34*b*. The valve 30 thus remains in condition for blocking refrigerant flow through the expansion device while the compressor remains cycled off. Condensed refrigerant thus remains in the condenser 14 throughout the "off" cycle of the compressor.

When the sensed space temperature rises sufficiently to cause the thermostat to cycle the compressor on again, the refrigerant pressure in the valve chamber 38 rises abruptly relative to the pressure in the chamber 36 because of the flow restricting orifice 47. The pressure differential thus created across the diaphragm 34 reopens the valve 30 to enable the condensed refrigerant to immediately begin flowing to the expansion device 16 via the valve 30. Equalization of the refrigerant pressure across the diaphragm 34 when the valve 30 is open is ineffective to change the diaphragm position and the valve 30 thus remains opened so long as the compressor continues to operate.

As noted previously the compressor 12 is constructed so that it is capable of starting against a refrigerant pressure head without stalling the drive motor 20. Compressors having such capabilities are known and therefore details of the compressor construction are not set forth.

The valve 30 has the advantage of being failsafe in operation. That is, if the diaphragm 34 should fail or a large refrigerant leakage path were to develop around the diaphragm, the valve 30 will simply remain open at all times and not interfere with operation of the refrigeration system 10.

During an initial "pull down" of the system 10, e.g. when the system is operated after it has remained inactive for a long period of time and is completely filled with refrigerant vapor at ambient atmospheric temperature, the valve 30 remains open as the pressure in the condenser slowly increases. Subsequent cycling of the compressor results in the valve 30 functioning as desired in the manner described.

FIGS. 2–5 illustrate a modified refrigeration system 10' which is substantially the same as the refrigeration system 10 illustrated by FIG. 1 with the exception of the refrigerant flow control valve, indicated by the reference character 130 in FIGS. 2–5, the refrigerant condensing heat exchanger, or condenser, 14' and the compressor 12'.

The refrigerant condenser 14' is formed by two heat exchange units **14*a'* and 14*b'* the first of which receives refrigerant discharged from a first compressor discharge 12*a'*, transfers heat from the refrigerant and returns the refrigerant to a second compressor inlet 12*b'*. The second condenser unit 14*b'* receives the refrigerant discharged from the compressor 12' and functions like the refrigerant condenser 14 referred to in connection with FIG. 1. The heat exchanger unit 14*a'*** enables oil entrained with refrigerant in the compressor to condense and return to the compressor so that the compressor remains lubricated at all times during operation of the system with a minimum amount of lubricant circulating through the system.

The refrigerant flow control valve 130 functions to block refrigerant flow to the expansion device and evaporator when the compressor cycles off and enables refrigerant flow from the condenser through the expansion device in response to the refrigerant compressor 12' being cycled on. The valve 130 is provided with a refrigerant intake port 132 communicating with the discharge of the condenser unit **14*b'*, a refrigerant exhaust port 134 by which refrigerant is delivered to the evaporator via the expansion device, and a refrigerant port 136 in pressure communication with the outlet of the first condenser unit 14*a'***.

The remaining portions of the system 10' are the same as described above in connection with FIG. 1 and are indicated by corresponding reference characters.

The refrigerant flow control valve 130 is formed by a housing 140 containing a refrigerant flow controlling valve assembly generally indicated by the reference character 142, and a refrigerant pressure responsive member 144 which operates the valve assembly 142. The housing 140 is preferably constructed from a generally cup-like sheet metal housing unit 150 having a second sheet metal closure member 152 hermetically joined to it. Molded plastic core members 154, 156 are disposed within the housing to provide internal refrigerant flow passages and to provide support for the valve assembly 142 and other internal components of the flow control valve 130.

Figure 2:
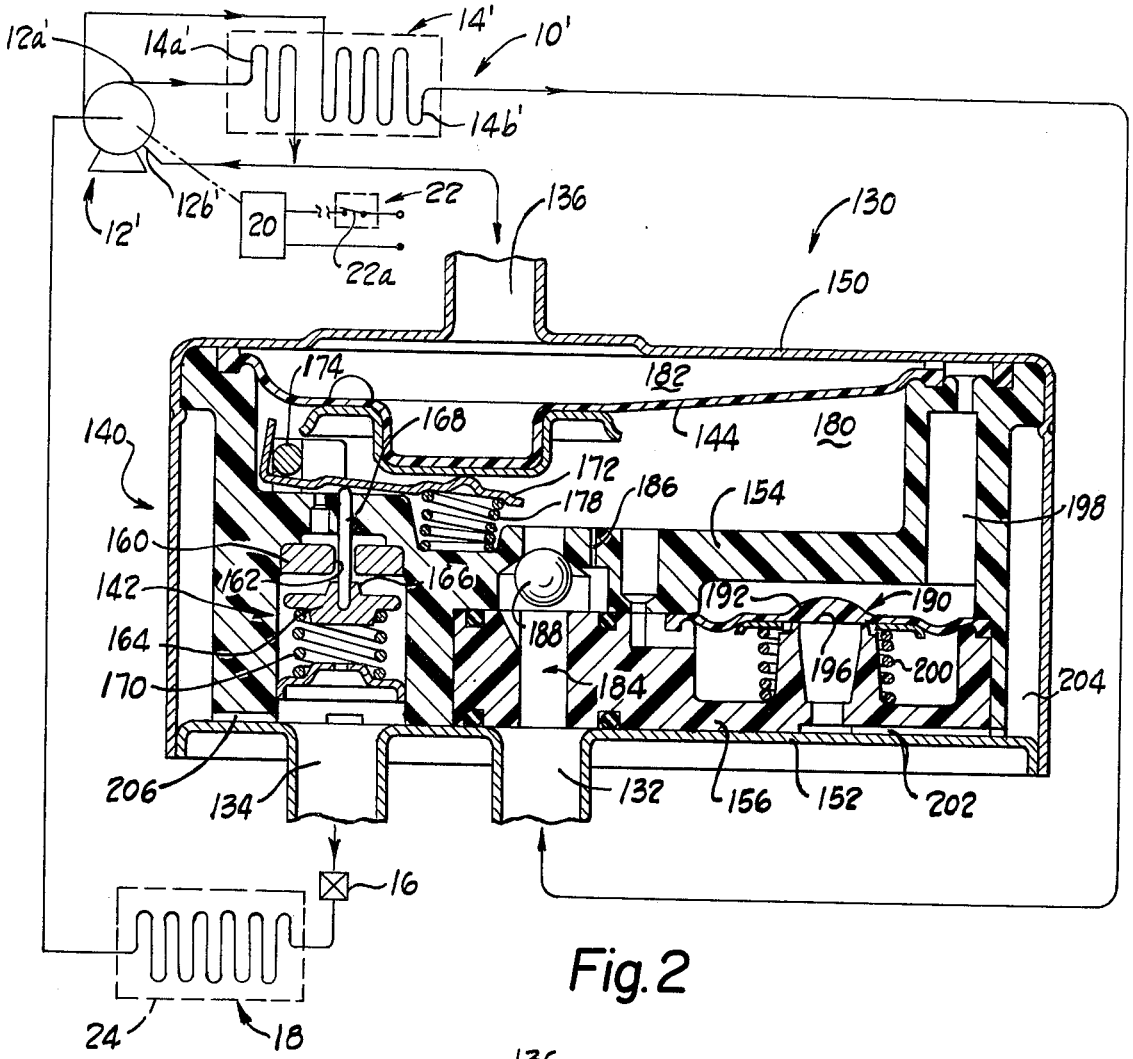
FIG. 2 schematically illustrates an alternative embodiment of a refrigeration system embodying the invention with portions illustrated in cross section; and, FIGS. 3–5 illustrate a portion of the system of FIG. 2 in cross section in various operative conditions.

Referring to FIG. 2 the valve assembly 142 is formed by a generally annular valve seat member 160 defining a central refrigerant flow passage 162 from which refrigerant flowing into the valve 130 through the intake port 132 may exit via the exhaust port 134. A poppet valving member 164 is disposed adjacent the valve seat 160 and defines a valving face 166 which, when seated on the valve seat 160, blocks flow of refrigerant from the housing 140. An operating pin 168 is joined to the poppet valving member and projects through the refrigerant flow passage 162. The valving member 164 is biased toward its closed position by a spring 170 which reacts between a suitable retainer element and the valving member itself.

The valve assembly 142 is movable between its open and closed positions by an actuating lever 172 which is supported adjacent the projecting end of the operating pin 168 for pivotal movement about a pivot pin 174. The projecting end 176 of the actuating lever extends beyond the location of the operating pin 168 and is associated with a biasing spring 178 which urges the actuating lever 172 in a direction for closing the valve assembly 142.

The refrigerant pressure responsive member 144 is preferably formed by a flexible rubber-like imperforate diaphragm which is seated between the housing element 150 and the core member 156 to define pressure chambers 180, 182 on its opposite sides.

During normal operation of the system 10' and when the compressor is operating, the valve assembly 142 permits refrigerant from the discharge of the refrigerant condensing heat exchanger unit **14*b'* to flow through the valve intake port 132 to the chamber 180 via a passage 184 formed by the core members 154, 156. FIG. 2 illustrates the valve 130 in this condition of operation. The refrigerant flows from the chamber 180 to the expansion device and evaporator via the valving assembly 142 and valve discharge port 134. It should be noted that refrigerant cannot flow from the valve 130 via the chamber 182 so that the refrigerant pressure in the chamber 182 remains substantially the same as the pressure at the discharge of the condenser unit 14*a'***.

The valve assembly 142 is conditioned to permit refrigerant flow through the valve 130 by the diaphragm 144. The refrigerant pressure exiting the condenser unit **14*a'* is communicated to the chamber 182 via the port 136. Since the refrigerant flowing to the chamber 180 is subjected to a pressure drop resulting from passage through the condenser unit 14*b'* and through a flow restrictor 186 formed in the passage 184, the refrigerant pressure in the chamber 182 is sufficiently greater than refrigerant pressure in the chamber 180 that the diaphragm 144 deflects toward and moves the projecting end of the actuating lever 172 to open the valve assembly 142**.

Figure 3:
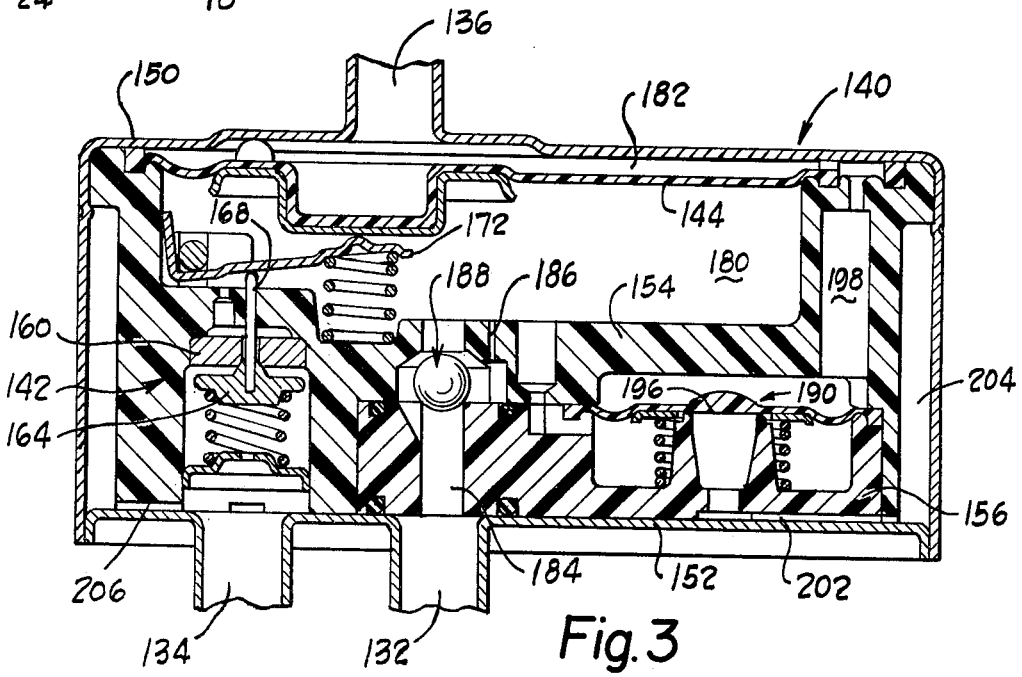

When the compressor 12' is cycled off, the refrigerant pressure at the discharge of the condenser unit **14*a'* decays rapidly compared to the decay rate of the refrigerant pressure at the discharge of the second condenser 14*b'* resulting in the diaphragm 144 being shifted away from the valve actuating lever 172. The valve assembly 142 is closed by the spring 170 acting on the valving member 164 to prevent further refrigerant flow into the expansion device. FIG. 3 illustrates the valve 130** in this condition of its operation.

When the compressor is reenergized the refrigerant pressure at the outlet of the condenser **14*a'* increases relatively rapidly compared to the refrigerant pressure rise at the discharge of the condenser 14*b*. The differential pressure forces are transmitted to the diaphragm 144 causing it to shift and reopen the valve assembly 142**.

In order to facilitate motion of the diaphragm 144 toward the actuating lever 172 the refrigerant passage 184 is provided with a ball check valve 188 which opens to enable substantially unrestricted flow of the liquid refrigerant from the chamber 180 into the passage 184 toward the discharge of the condenser **14*b'*. This assures that motion of the diaphragm 144 is not impeded by the liquid phase refrigerant in the chamber 180 as it might otherwise be if the liquid refrigerant were trapped in the chamber 180 and forced to flow through the restrictor 186. The check valve 188 is illustrated in its non-restricting condition in FIG. 3. As soon as liquid refrigerant begins to flow through the valve 130 the ball check valve 188 is returned to its flow restricting position as illustrated by FIG. 2**.

Under certain circumstances the refrigerant pressure in the high pressure side of the system 10' may increase during the compressor off cycle and reach a level at which the compressor cannot safely be started without possible damage to it or its drive motor. When this occurs the valve assembly 142 opens briefly to permit a small amount of refrigerant to flow through it to the expansion device and thus relieve the back pressure against which the compressor must work when it is next cycled on. The pressure relief function of the valve assembly 142 is controlled by the area of the poppet valving member 164 and operating pin 168 exposed to the high pressure refrigerant (in the chamber 180) and the force exerted by the biasing spring 170 on the poppet valving member. Movement of the poppet valving member 164 to relieve the high pressure side of the system 10' occurs independently of the actuating lever 172. When the refrigerant pressure is relieved the spring 170 recloses the valve assembly.

When the refrigeration system 10' has been out of use for a considerable period of time the refrigerant pressure in the system may equalize with substantially all of the refrigerant in the system returning to its gaseous or vapor state. The valve assembly 142 is closed by virtue of the forces provided by the biasing springs 170, 178 which coact to assure closure of the poppet valving member 164 on its seat 160 in the absence of differential refrigerant pressures.

Figure 4:
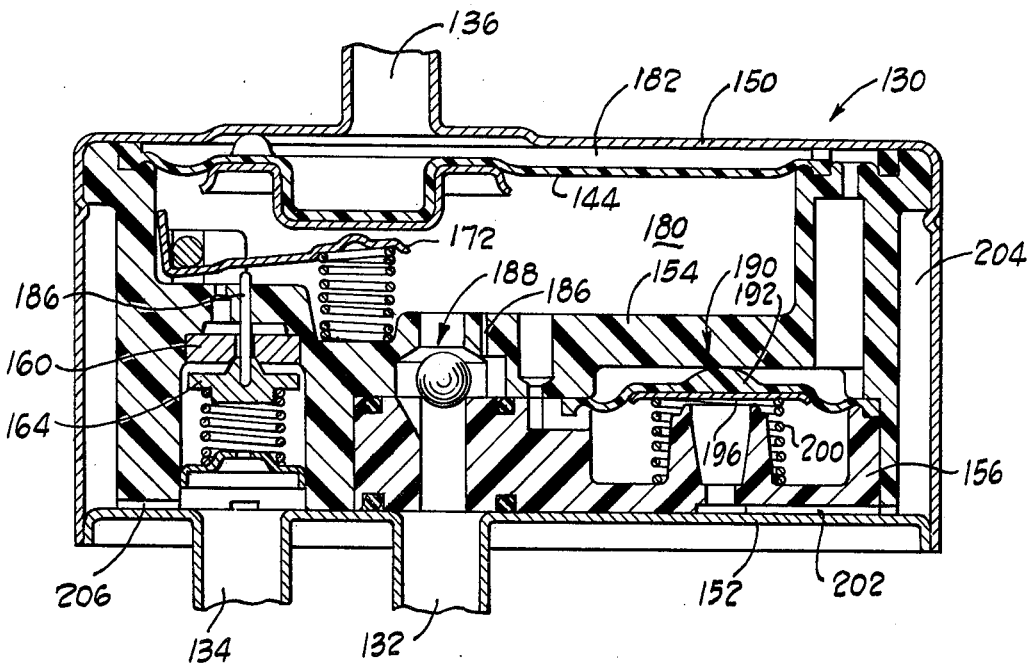

When the compressor is first operated at the conclusion of a long period of system inactivity, the refrigerant in the condenser 14' is in its gaseous state. Operation of the compressor does not therefore initially create significant pressure rises in the condenser and for this reason the diaphragm 144 tends to remain stationary. The refrigerant pressure buildup in the high pressure side of the system 10' can be so gradual that differential refrigerant pressure across the diaphragm 144 remains inadequate to enable the diaphragm to open the valve assembly 142. In some circumstances, therefore, the valve assembly 142 can remain closed as the compressor continues to operate, preventing refrigerant flow to the evaporator. In effect, the system would appear to be inoperative since no refrigeration effect would result. FIG. 4 of the drawings illustrates the flow control valve 130 and these circumstances.

In order to avoid the possibility of the flow control valve 130 preventing normal operation of the system 10' after a sustained period of system inactivity, a bypass valve 190 is provided to assure refrigerant flow through the flow controlling valve 130 during an initial cycle of compressor operation. The valve 190 is preferably formed by a flexible rubber-like diaphragm 192 supported between the core members 154, 156 for movement toward and away from a relatively large area valving port 196 formed on a hollow projection 197 molded into the core member 156.

The diaphragm 192 is imperforate and has its major face opposite from the valve port 196 exposed to pressure from the discharge of the condenser **14*a'*. Pressure from the condenser 14*a'* is transmitted to the diaphragm 192 via the refrigerant port 136, the chamber 182 and a passage 198 formed in the core member 154 between the chamber 182 and the diaphragm 192. This refrigerant pressure tends to close the bypass valve 190 by urging the diaphragm 192 into sealing engagement with the valve seat 196. The refrigerant pressure from the condenser 14*a'* is opposed by a biasing spring 200 reacting between the diaphragm 192 and the core member 156 and refrigerant pressure forces applied to the opposite face of the diaphragm 192**.

FIG. 4 illustrates the condition of the flow control valve 130 at the end of the a long period of system inactivity with refrigerant pressure in the system 10' equalized. The refrigerant pressure forces acting on the opposite faces of the diaphragm 192 are balanced and the bypass valve is open because the spring 200 maintains the diaphragm 192 spaced from the port 196.

Figure 5:
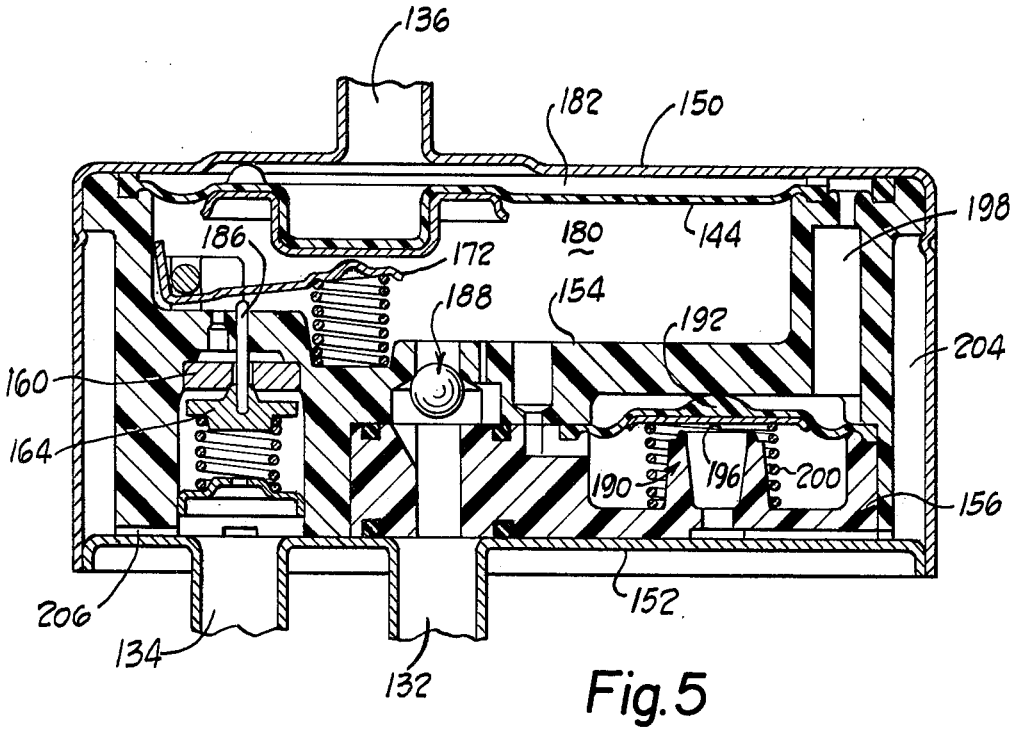

When the compressor is cycled on, gaseous refrigerant begins to flow through the system 10' via the open bypass valve 190. This condition of the flow control valve 130 is illustrated by FIG. 5. The refrigerant flows from the condenser **14*b'* through the valve intake port 132, the passage 184, a passage 202 between the chamber 180 and the bypass valve 190, and to the expansion device 16 and evaporator 18 through the bypass valve port 196 and flow passages 202, 204, 206 formed internally in the flow control valve 130. The flow passage 202 is formed by a slot-like channel in the core member 156 which communicates with the bypass valve seat 196 and directs refrigerant flowing through the bypass valve into the passage 204. The passage 204 is formed by an annular chamber extending about the housing 140 and formed between the core member 154 and the housing member 150. The passage 206 is constructed like the passage 202 and extends between the passage 204 and the valve refrigerant outlet port 134**.

The flow of gaseous refrigerant through the passage 184 is effective to close the ball check valve 188 but the pressure drops created by the condenser unit **14*b'* and restrictor 186 in the flow of the gaseous refrigerant are insufficient to force closure of the bypass valve 190**.

As the compressor continues operating, the refrigerant begins liquefying in the condenser 14' and eventually liquified refrigerant flows into the valve 130 from the condenser unit **14*b*'. The flow of liquefied refrigerant from the condenser results in the establishment of differential fluid pressure forces on the diaphragm 144 (due to the pressure drops created by the condenser unit 14*b*' and the flow restrictor 186) which causes the valve assembly 142** to open as described previously.

The differential refrigerant pressure is likewise applied to the bypass valve diaphragm 192 resulting in the diaphragm 192 seating on the valve port 196 and blocking further bypass flow. The flow control valve 130 thus returns to its operating condition illustrated by FIG. 2.

The bypass valve 190 remains closed during subsequent normal operation of the system 10'. After the bypass valve closes the refrigerant pressure acting on the diaphragm 192 within the area of the bypass valve port 196 is reduced below the pressure in the chamber 180, primarily by virtue of the pressure drop experienced by the refrigerant flowing through the valve assembly 142. Accordingly the net closing force acting on the diaphragm 192 increases and is effective to prevent the diaphragm 192 from reopening as soon as the compressor cycles off. When the compressor is cycled off, and the valve assembly 142 closes, the refrigerant pressure acting on the diaphragm 192 within the are of the bypass valve port 196 continues to be reduced to approximately the same level as the evaporator. This assures that the net actuating force applied to the diaphragm 192 is sufficient to maintain the bypass valve closed throughout a compressor off cycle of any reasonably expectable duration.

While preferred embodiments of the invention have been illustrated and described in considerable detail the invention is not to be considered limited to the precise constructions disclosed. Various adaptations, modifications and uses of the invention may occur to those skilled in the art to which the invention relates and it is the intention to cover all such adaptations modification and uses coming within the scope or spirit of the appended claims.

What is claimed is:

1. In a refrigeration system including a compressor, a refrigerant condensing heat exchanger, a refrigerant evaporating heat exchanger, a refrigerant expansion device for enabling condensed refrigerant to expand into said evaporating heat exchanger and a control device for cycling the compressor on and off according to a sensed condition, the improvement comprising: refrigerant flow controlling valve means for blocking flow of refrigerant between the refrigerant condensing heat exchanger and the refrigerant evaporating heat exchanger when the compressor is cycled off and for enabling refrigerant flow between the refrigerant condensing heat exchanger and the refrigerant evaporating heat exchanger when the compressor is cycled on, said valve means including a refrigerant pressure responsive member movable to condition said valve means to block refrigerant flow in response to changes in refrigerant pressure caused by the compressor cycling off and movable to condition the valve means to enable refrigerant flow in response to changes in refrigerant pressure caused by the compressor cycling on.

2. The system claimed in claim 1 wherein said pressure responsive member comprises a flexible diaphragm and further including structure for transmitting refrigerant pressure from the refrigerant condensing heat exchanger to opposite sides of said diaphragm and means effective to retard the transmission of pressure changes to one side of the diaphragm.

3. The system claimed in claim 1 further including structure for transmitting refrigerant pressure from the refrigerant condensing heat exchanger to opposed pressure faces of said pressure responsive member and means effective to retard the transmission of pressure changes to one of said pressure faces.

4. The system claimed in claim 3 wherein said structure for transmitting refrigerant pressure comprises refrigerant flow passages communicating refrigerant exiting said refrigerant condensing heat exchanger to said pressure faces.

5. The system claimed in claim 4 wherein said refrigerant flow passages receive refrigerant which has flowed substantially completely through said refrigerant condensing heat exchanger and said means for retarding transmission of refrigerant pressure changes comprises a flow restriction in one of said refrigerant flow passages.

6. The system claimed in claim 1 wherein said member comprises a flexible diaphragm and said valve means comprises valving structure defining a port adjacent said diaphragm and a valving face formed by said diaphragm which seats on said port to block refrigerant flow.

7. The system claimed in claim 1 wherein said refrigerant expansion device is disposed between said valve means and said refrigerant evaporating heat exchanger.

8. A method of conserving energy in the operation of a compressor-condenser-evaporator type refrigeration system wherein the compressor operation is initiated and terminated in response to a sensed condition comprising:

(a) sensing a reduction in refrigerant pressure resulting from termination of operation of the compressor;

(b) blocking refrigerant flow to the evaporator in response to the sensed reduction in refrigerant pressure so that refrigerant remains in the condenser while the compressor remains inactive;

(c) sensing an increase in refrigerant pressure resulting from initiation of compressor operation; and (d) enabling refrigerant flow to the evaporator in response to the increase in refrigerant pressure.

9. The method claimed in claim 8 wherein blocking refrigerant flow includes transmitting changes in refrigerant pressure to opposed pressure faces of a refrigerant flow controlling valve actuating member and retarding the transmission of such pressure changes to one pressure face.

10. In a refrigeration system comprising a positive displacement refrigerant compressor, a refrigerant condenser, an expansion valve and a refrigerant evaporator: a refrigerant flow controlling valve having an open position for enabling flow of refrigerant in said system and a closed position for blocking flow of refrigerant to the refrigerant evaporator and a valve actuator system effective to operate said valve to said closed position in response to a sensed change in refrigerant pressure indicative of termination of operation of said compressor, said valve actuator effective to operate said valve to said open position in response to a sensed change in refrigerant pressure indicating initiation of operation of said compressor, said refrigerant flow controlling valve maintaining a relatively high refrigerant pressure in said refrigerant condenser during periods when said compressor is not operating.

11. The system claimed in claim 10 wherein said valve actuator system comprises a flexible diaphragm, refrigerant directing means for directing refrigerant flowing from a condenser outlet to one side of said diaphragm and second refrigerant directing means for directing refrigerant flow from the condenser to the other side of said diaphragm and refrigerant flow restricting means between said condenser outlet and the other side of said diaphragm, said flow restricting means effective to create a differential pressure acting on said diaphragm when operation of said compressor is initiated and terminated.

12. The system claimed in claim 11 wherein said flow restricting means comprises a refrigerant flow restricting orifice.

* * * * *